United States Patent [19]

Imamura et al.

[11] Patent Number: 4,957,717

[45] Date of Patent: Sep. 18, 1990

[54] METHOD OF DISPOSAL OF ORGANIC CHLORINE COMPOUNDS BY COMBUSTION

[75] Inventors: Seiichiro Imamura, Kyoto; Sadao Terui; Kunio Sano, all of Hyogo; Kazuyoshi Nishikawa, Himeji; Akira Inoue, Hirakata, both of Japan

[73] Assignee: Nippon Shokubai Kagaku Kogyo Co., Ltd., Osaka, Japan

[21] Appl. No.: 461,120

[22] Filed: Jan. 4, 1990

[30] Foreign Application Priority Data

Jan. 9, 1989 [JP] Japan ..... 1-1161
Nov. 8, 1989 [JP] Japan ..... 1-292067

[51] Int. Cl.[5] ..... C01B 7/01; C01B 3/22; B01D 53/36

[52] U.S. Cl. ..... 423/240; 423/481; 423/245.3; 208/262.5

[58] Field of Search ..... 423/240, 245.3, 481; 208/262.5, 262.1

[56] References Cited

U.S. PATENT DOCUMENTS

| | | | |
|---|---|---|---|
| 3,453,073 | 7/1969 | Sims | 423/481 |
| 3,845,191 | 10/1974 | Bruce | 423/240.5 |
| 4,031,149 | 6/1977 | Eden | 423/481 |
| 4,059,676 | 11/1977 | Yang et al. | 423/240 S |
| 4,468,376 | 8/1984 | Suggitt | 423/240 R |
| 4,485,081 | 11/1984 | Magistro | 423/240 R |
| 4,533,530 | 8/1985 | Hartmann | 423/240 R |

FOREIGN PATENT DOCUMENTS

| | | | |
|---|---|---|---|
| 8700157 | 1/1987 | PCT Int'l Appl. | 423/240 S |

*Primary Examiner*—Jeffrey E. Russel
*Assistant Examiner*—Brian M. Bolam
*Attorney, Agent, or Firm*—Oblon, Spivak, McClelland, Maier & Neustadt

[57] ABSTRACT

A method of disposing of organic chlorine compounds by burning them in contact with a catalyst of composite oxides selected from titanium-silicon composite oxides, titanium-zirconium composite oxides, and titanium-silicon-zirconium composite oxides, whereby the resulting hydrogen chloride (HCl) is adsorbed by a basic absorbent.

3 Claims, No Drawings

METHOD OF DISPOSAL OF ORGANIC CHLORINE COMPOUNDS BY COMBUSTION

BACKGROUND OF THE INVENTION

The present invention relates to the method of disposal of organic chlorine compounds by combustion, and more particularly to a method of disposing of organic chlorine compounds by conversion of the chlorine content into hydrogen chloride (HCl) which is adsorbed by a basic absorbent, thereby eliminating the chlorine content completely.

To disposing of organic chlorine compounds, the common practise is to burn them at such a high temperature as 800° C. or even higher. However, this known method requires the generation of a high heat which involves the consumption of fuel and is likely to produce toxic chlorine gases which constitute a public hazard.

There is known another method which decomposes organic chlorine compounds by oxidation with the use of a catalyst of transition metal oxides. An example is disclosed in Japanese Patent Publication (unexamined) No. 51-22699. This method is more advantageous than the first-mentioned method in that the generation of a high heat is not necessitated. However the problems of chlorine gases remain unsolved.

SUMMARY OF THE INVENTION

Accordingly, an object of the present invention is to provide a method of disposing of organic chlorine compounds by combustion at a relatively low temperature and without emitting toxic chlorine gases.

According to the present invention there is a method of disposing of organic chlorine compounds by combustion, the method comprising burning organic chlorine compounds placed in contact with a catalyst of composite oxides selected from titanium-silicon composite oxides, titanium-zirconium composite oxides and titanium-silicon-zirconium composite oxides, whereby the chlorine content is converted into hydrogen chloride (HCl).

The resulting hydrogen chloride is adsorbed by a basic absorbent, thereby avoiding the generation of toxic chlorine compounds. Then the residue after the combustion is burnt until it is burned off. Preferably the organic chlorine compounds are placed in contact with the catalyst at the presence of hydrogen source.

DETAILED DESCRIPTION OF THE PREFERRED EMBODIMENTS

The organic chlorine compounds treated by the method of the present invention are organic compounds which contain at least one chlorine atom; for example, aliphatic organic chlorides such as methyl chloride, ethyl chloride, dichloroethylene, trichloroethylene, vinyl chloride, aromatic organic chlorides such as monochlorobenzene, dichlorobenzene, and other types of organic chlorides such as acetyl chlorides, chloroacetic acids. Flon gas, commonly referred to as "F11", "F12", "F13", "F22", "F113+ and "F114", are also included in the treating organic chlorine compounds. The chloride and fluorine contents in Flon gas are respectively converted into hydrogen chloride and hydrogen fluoride, which are adsorbed by a basic absorbent. Solid organic chlorine compounds such as PCB and 2,4,5-trichlorophenoxide acetic acid can be burnt without using a catalyst, but if the present invention is applied, the chlorine content in the exhaust gases will be burnt off.

The oxygen-content combustion accelerator can be taken from the atmospheric air or can be especially made.

In the present invention it is essential to use one or more catalyst selected from titanium-silicon composite oxides, titanium-zirconium composite oxides, and titanium-silicon-zirconium composite oxides. The catalyst facilitates the conversion of chloride into hydrogen chloride (HCl) at a relatively low temperature. The advantage of these catalysts is that the catalytic action lasts for a long time because of having no carbon deposits in the surfacial layers of the catalyst. Other types of catalysts such as transition metal oxides are not suitable because of causing toxic chloride gases, and common solid catalysts such as silica alumina, mordenite and zeolite are not efficient because of quickly losing their resolving power or catalytic action due to carbon deposits in the surfacial layers thereof.

In general, titanium-silicon composite oxides, titanium-zirconium composite oxides, and titanium-silicon-zirconium composite oxides are known as solid acids, and have such a high degree of acidity as not shared by a mere aggregation of oxides of individual elements. In addition, they have a relatively wide contact surface. Owing to the composite structure they exhibit a superior catalytic action to that achieved by a mere aggregation of oxides of individual elements. More specifically, the composite structure of the catalyst facilitates the decomposition of organic chlorine compounds at relatively low temperatures, and converts the chlorine content into hydrogen chloride which is smoothly adsorbed by a basic absorbent.

It is preferred that the catalyst of composite oxides has the following composition:

$TiO_2$: 20 moles % to 95 moles % and $SiO_2$, $ZrO_2$ or $SiO_2+ZrO_2$: 5 moles % to 80 moles % wherein it is assumed that $TiO_2+SiO_2+ZrO_2$ is equal to 100 moles %.

Preferably the catalyst has a surface area of not smaller than 30 $m^2/g$. The catalyst is prepared in the following manner:

(1) Titanium tetrachloride is mixed with silica sol with the addition of ammonia to allow it to precipitate. The precipitate is cleaned and dried, and calcined at a temperature of 300° C. to 650° C. to obtain titanium-silicon composite oxides.

(2) A sodium silicate solution is added to titanium tetrachloride to allow it to precipitate. The precipitate is cleaned and dried. Then it is calcined at a temperature of 300° C. to 650° C. to obtain titanium-silicon composite oxides.

(3) Titanium tetrachloride is dissolved in water-alcohol solution with the addition of ethyl silicate, and the resulting solution is hydrolyzed to obtain a precipitate. Then after being cleaned and dried, the precipitate is calcined at a temperature of 300° C. to 650° C. to obtain titanium-silicon composite oxides.

(4) Oxidized titanium chloride ($TiOCl_2$) and ethyl silicate are dissolved in water-alcohol solution, and the resulting solution is mixed with ammonia to obtain a precipitate. Then the precipitate is calcined at a temperature of 300° C. to 650° C. to obtain titanium-silicon composite oxides.

Of the methods described above the method (1) is most preferable. Likewise, titanium-silicon composite oxides, titanium-zirconium composite oxides, and titanium-silicon-zirconium composite oxides are prepared by obtaining zirconium from inorganic zirconium compounds such as zirconium chloride and zirconium sulfate and organic zirconium compounds such as zirconium oxalate.

The composite oxides obtained in this way are pulverized and kneaded with the addition of water and a suitable molding powder. The dough of composite oxides is extruded into pellets or honeycombs by an extruder. The molded mass is allowed to dry at a temperature of 50° C. to 120° C., and then calcined in a stream of air at a temperature of 300° C. to 800° C. (preferably, 350° C. to 600° C.) for 1 to 10 hours (preferably 2 to 6 hours).

The method of the present invention is carried out in the following manner:

Organic chlorides compounds are burnt in an oxygen-content gas preferably at a temperature of 300° C. to 700° C. while being in contact with at least one catalyst of composite oxides selected from titanium-silicon composite oxides, titanium-zirconium composite oxides, and titanium-silicon-zirconium composite oxides, whereby the chlorine content is converted into hydrogen chloride (HCl).

The resulting hydrogen chloride is adsorbed by a basic absorbent. In this way the chlorine content is eliminated. Under the conventional methods organic chlorine compounds are decomposed into chlorine gases, which are difficult to be adsorbed by a basic absorbent. The present invention has solved this difficulty by conversion the organic chlorine compounds into hydrogen chloride which is easily adsorbed by a basic absorbent.

The basic absorbent includes alkaline earth metals such as calcium oxides, magnesium oxides, and hydroxides of alkaline metals such as sodium hydroxide and potassium hydroxides.

The gaseous residue after the hydrogen chloride is eliminated is burnt until the carbon monoxide therein is converted into carbon dioxide preferably at the presence of a combustion catalyst which effects the conversion at a relatively low temperature. The combustion catalyst includes noble metals such as platinum and palladium, and transition metals such as iron, cobalt, nickel, copper, and manganese.

In the foregoing description it is presupposed that the organic chlorides contain a lot of hydrogen atoms. However, there are some organic chlorides contain no hydrogen atoms or smaller number of hydrogen atoms than the chloride atoms. In such cases it is preferred that the organic chlorides are placed in contact with the catalyst at the presence of hydrogen source so that the chlorine content is smoothly converted into hydrogen chloride. However, this does not mean that the introduction of a hydrogen source is not necessary when the organic chlorides contains hydrogen atoms. Even in such cases it is preferable to incorporate a hydrogen source to facilitate the conversion of the chlorine content into hydrogen chloride. The hydrogen source includes a steam, a tanked hydrogen and ammonia, of which the steam is safest, most economical and most efficient. Hydrogen atoms are added in a not smaller than equimolar quantity with that of chlorine atoms. However an excessive quantity of hydrogen atoms is not economical; preferably the ratio of hydrogen atoms to chlorine atoms is not more than 10.

The present invention will be more particularly described by way of examples; it should be understood, however, that the examples are given by way of illustration only and various changes and modifications are possible within the spirit of the invention.

The conversion efficiency of organic chlorides and the yields of carbon monoxide and carbon dioxide were measured by gas chromatography. The yields of hydrogen chloride and hydrogen fluoride were measured by the Volhard method, and the yields of chlorine and fluorine were measured by an iodometric titration.

EXAMPLE (1)

(a) The Preparation of a Composite Oxides Catalyst

Titanium-silicon composite oxides was prepared in the following manner:

A sulfate solution of titanium sulfate having the following composition was used as a titanium source:

$TiOSO_4$ (in terms of $TiO_2$): 250 g/l

Total $H_2SO_4$: 1100 g/l.

28 l of 25 wt % ammonia aqueous solution was added to 40 l of water, to which 2.4 kg of "Snow Tecks-NCS-30" (silica sol manufactured by Nissan Kagaku, which contains about 30 wt % $SiO_2$) was added. The sulfate solution of titanium sulfate was added to the resulting solution by 5.3 l together with 30 l of water. Then the titanium-content sulfate solution was gradually added and mixed to obtain a coprecipitation gel of $TiO_2$ and $SiO_2$, which was allowed to stand for 15 hours. The resulting gel was filtered and washed, and dried at 200° C. for 10 hours.

The dried gel was calcined at 550° C. for 6 hours in a stream of air, and pulverized into powder. The powder was molded in pellets, thus obtaining titanium-silicon base composite oxides catalyst (molar ratio: $TiO_2$:$SiO_2$=4:1). This catalyst had a surface area of 185 $m^2/g$.

(b) Disposal of Organic Chlorides by Combustion

Air containing 10,000 ppm of 1,2-dichloroethane was passed through the catalyst of titanium-silicon composite oxides obtained in (a) at 400° C. at a space velocity of 3,600 $hr^{-1}$. The exhaust gas was passed through calcium oxide, and then through platinum catalyst (0.2 wt % platinum supported on alumina) at 400° C.

The conditions and results are shown in Table (1). No hydrogen chloride was detected in the exhaust gas after the platinum catalytic treatment.

COMPARATIVE EXAMPLE (1)

The organic chlorides compounds were disposed of by combustion under the same conditions described above except for the titanium-silicon composite oxide catalyst which was substituted by mordenite. The conditions and results are shown in Table (1). No chlorine gas was detected in the exhaust gas but it was detected in the exhaust gas after the platinum catalytic treatment, which required a further process of removing it. This chlorine content resulted from the decomposition of 1,2-dichloroethane by the platinum catalytic treatment, which was left out of the mordenite treatment. After the combustion was finished, carbon was detected in the form of precipitating deposits on the mordenite.

COMPARATIVE EXAMPLE (2)

The organic chlorides compounds were disposed of by combustion under the same conditions as those in Example (1), except the titanium-silicon composite oxide catalyst which was substituted by silica-alumina. The conditions and results are shown in Table (1). No chlorine gas was detected in the exhaust gas after the silica-alumina treatment but it was detected in the exhaust gas after the platinum catalytic treatment, which required a further process of removing it. This chlorine content resulted from the decomposition of 1,2-dichloroethane by the platinum catalyst treatment, which was left out of the silica-alumina treatment. After the combustion was finished, carbon was detected in the form of precipitating deposits on the silica-alumina.

EXAMPLE (2)

(a) The Preparation of a Composite Oxides Catalyst

Titanium-zirconia composite oxides was prepared in the following manner:

1.93 kg of oxychlorinated zirconium ($ZrOCl_2.8H_2O$) was dissolved in 100 l of water, to which 7.8 l of a sulfate solution of titanium sulfate having the same composition as that used in Example (1) was added and blended. The resulting solution was stirred at about 30° C., and an ammonium solution was gradually added until the pH value reached 7. Then it was allowed to stand for 15 hours. The resulting gel was filtered, and washed. Then it was allowed to dry at 200° C. for 10 hours.

The dried gel was calcined at 550° C. for 6 hours in a stream of air, and pulverized into powder. The powder was molded into pellets. In this way a catalyst of titanium-zirconia composite oxides (molar ratio: $TiO_2$—$ZrO_2$=4:1) was obtained. This catalyst had a surface area of 140 $m^2/g$.

(b) Disposal of Organic Chlorides by Combustion

Air containing 10,000 ppm of ethyl chloride was passed through the catalyst of titanium-zirconia composite oxides obtained in (a) at 400° C. at a space velocity of 3,600 $hr^{-1}$. The exhaust gas was passed through calcium oxide, and then through platinum catalyst (0.2 wt % platinum supported on alumina) at 400° C.

The conditions and results are shown in Table (1). No hydrogen chloride was detected in the exhaust gas after the platinum catalytic treatment.

EXAMPLE (3)

(a) The Preparation of a Composite Oxides Catalyst

Titanium-silicon-zirconium composite oxides was prepared in the same manner as described in Examples (1) and (2), wherein the molar ratio was TiO2:SiO2:ZrO2=7:2:1.

(b) Disposal of Organic Chlorides by Combustion

Air containing 10,000 ppm of dichlorobenzene was passed through the catalyst of titanium-silicon-zirconium composite oxides obtained in (a) at 500° C. at a space velocity of 3,600 $hr^{-1}$. The exhaust gas was passed through calcium oxide, and then through platinum catalyst (0.2 wt % platinum supported on alumina) at 400° C.

The conditions and results are shown in Table (1). No hydrogen chloride was detected in the exhaust gas after the platinum catalytic treatment.

TABLE 1

(by mole percentage)

| | Catalysts | Organic Chlorine Compounds | | Gases after Treatment | | | | Final Gases |
|---|---|---|---|---|---|---|---|---|
| | | Name | Conv. | CO | $CO_2$ | HCl | $Cl_2$ | $CO_2$ |
| E. 1 | Ti—Si | (A) | 99 | 70 | 29 | 100 | 0 | 98 |
| C. 1 | mordenite | (A) | 73 | 19 | 12 | 47 | 0 | 87 |
| C. 2 | Silica—alumina | (A) | 52 | 2 | 5 | 32 | 0 | 82 |
| E. 2 | Ti—Zr | (B) | 99 | 65 | 24 | 99 | 0 | 99 |
| E. 3 | Ti—Si—Zr | (C) | 99 | 62 | 27 | 100 | 0 | 98 |

(Note)
Catalysts are composite oxides.
Gases after treatment is exhaust gases after the catalytic treatment.
E. 1, E. 2 and E. 3 stand for Example (1), Example (2) and Example (3), respectively. C. 1 and C. 2 stand for Comparative Example (1) and Comparative Example (2).
(A) is 1, 2-dichloroethane.
(B) is ethyl chloride.
(C) is dichlorobenzene.
Conv. stands for conversion ratio. The numbers for each column of CO, $CO_2$, HCl, $Cl_2$and $CO_2$ represent each yield.
Final Gases are exhaust gases finally obtained.

EXAMPLE (4)

Air containing 10,000 ppm (V/V) of trichloroethylene was passed, with the addition of 5 wt % of water, through the catalyst of titanium-silicon composite oxides obtained in Example (1) at 500° C. at a space velocity of 3,600 $hr^{-1}$. The exhaust gas was passed through calcium oxides, and then through platinum catalyst (0.2 wt % platinum supported on alumina) at 400° C.

The conditions and results are shown in Table (2). No hydrogen chloride was detected in the exhaust gas after the platinum catalytic treatment.

EXAMPLE (5)

Air containing 5,000 ppm (V/V) of trichloroethylene was passed, with the addition of 1.2 vol % of hydrogen, through the catalyst of titanium-silicon composite oxides obtained in Example (1) at 500° C. at a space velocity of 3,600 $hr^{-1}$. The exhaust gas was passed through calcium oxides, and then through platinum catalyst (0.2 wt % platinum supported on alumina) at 300° C.

The conditions and results are shown in Table (2). No hydrogen chloride was detected in the exhaust gas after the platinum catalytic treatment.

EXAMPLE (6)

Air containing 10,000 ppm (V/V) of 1,2-dichloroethan was passed, with the addition of 2 vol % of steam, through the catalyst of titanium-silicon composite oxides obtained in Example (1) at 400° C. at a space velocity of 3,600 $hr^{-1}$. The exhaust gas was passed through calcium oxides, and then through platinum catalyst (0.2 wt % platinum supported on alumina) at 400° C.

The conditions and results are shown in Table (2). No hydrogn chloride was detected in the exhaust gas after the platinum catalytic treatment.

TABLE 2

(by mole percentage)

| | Catalysts | Organic Chlorine Compounds Name | Conv. | Gases after Treatment CO | $CO_2$ | HCl | $Cl_2$ | Final Gases $CO_2$ |
|---|---|---|---|---|---|---|---|---|
| E. 4 | Ti—Si | (D) | 99 | 75 | 24 | 100 | 0 | 98 |
| E. 5 | Ti—Si | (D) | 100 | 50 | 50 | 100 | 0 | 100 |
| E. 6 | Ti—Si | (A) | 100 | 8O | 20 | 100 | 0 | 100 |

(Note) E. 4, E. 5 and E. 6 stand for Example (4), Example (5) and Example (6), respectively. (D) is trichloroethylene.

EXAMPLE (7)

(a) The Preparation of a Composite Oxides Catalyst

Titanium-silicon composite oxides (molar ratio: $TiO_2:SiO_2=4:1$) was prepared in the same manner as described in Example (1):

(b) Disposal of Organic Chlorides by Combustion

Air containing 5,000 ppm (v/v) of "Flon 31" ($CH_2ClF$) was passed through the catalyst of titanium-silicon composite oxides obtained in Example (1) at 550° C. at a space velocity of 2,000 $hr^{-1}$. The exhaust gas was passed through calcium oxides.

Two hours after the exhaust gas was passed through the calcium oxides, the gas at the outlet of titanium-silicon composite catalyst was analyzed to examine the decomposition of flon and the contents of the products. Then the catalyst was taken out and its strength was measured for comparison with a fresh catalyst.

The comparison was conducted by a "KIYA" type strength tester, and 10 pieces of catalysts were crushed to see the average strength against destruction. Table (3) shows the analysis of the gases and the results of crushing tests.

While the decomposition of flon was in process, no hydrogen chloride or hydrogen fluoride was detected in the exhaust gases at the outlet of the calcium oxides layers.

EXAMPLE (8)

(a) The Preparation of a Composite Oxides Catalyst

Titanium-silicon composite oxides (molar ratio: $TiO_2:SiO_2=4:1$) was prepared in the same manner as described in Example (1):

(b) Disposal of Organic Chlorides by Combustion

Air containing 5,000 ppm (v/v) of "Flon 12" ($CF_2Cl_2$) was passed, with the addition of 5 vol % of steam, through the catalyst of titanium-silicon composite oxides obtained in Example (1) at 550° C. at a space velocity of 2,000 $hr^{-1}$. The exhaust gas was passed through calcium oxides.

The exhaust gases were analyzed and the strength of the catalyst against crushing was measured both in the same manner as in Example (7)-(b). The results are shown in Table (3).

While the decomposition of flon was in process, no hydrogen chloride or hydrogen fluoride was detected in the exhaust gases at the outlet of the calcium oxides layers.

EXAMPLE (9)

(a) The Preparation of a Composite Oxides Catalyst

Titanium-silicon composite oxides (molar ratio: $TiO_2:SiO_2=4:1$) was prepared in the same manner as Example (1):

(b) Disposal of Organic Chlorides by Combustion

Air containing 2,000 ppm (v/v) of "Flon 12" ($CF_2Cl_2$) was passed, with the addition of 5,000 ppm (v/v) of hydrogen, through the catalyst of titanium-silicon composite oxides obtained in Example (1) at 550° C. at a space velocity of 2,000 $hr^{-1}$. The exhaust gas was passed through calcium oxides.

The exhaust gases were analyzed and the strength of the catalyst against crushing was measured both in the same manner as in Example (7)-(b). The results are shown in Table (3).

While the decomposition of flon was in process, no hydrogen chloride or hydrogen fluoride was detected in the exhaust gases at the outlet of the calcium oxides layers.

TABLE 3

(by mole percentage)

| | FLON | Decom. | Contents of Gases CO | $CO_2$ | HF | HCl | $F_2$ | $Cl_2$ | Strength v. Destruction |
|---|---|---|---|---|---|---|---|---|---|
| E. 7 | Flon 31 | 98 | 0 | 98 | 98 | 98 | 0 | 0 | 0.98 |
| E. 8 | Flon 12 | 97 | 0 | 97 | 97 | 98 | 0 | 0 | 0.99 |
| E. 9 | Flon 12 | 97 | 0 | 97 | 97 | 98 | 0 | 0 | 0.98 |

(Note) E. 7, E. 8 and E. 9 stand for Example (7), Example (8) and Example (9), respectively. Decom. stands for decomposition ratio. Example (8) and Example (9), respectively. Contents of Gases are elements contained in the exhaust gases at the outlet of the catalyst, in terms of productivity. Strength v. Destruction is the results obtained by the 'KIYA' type strength tester. destruction

What is claimed is:

1. A method of disposing of organic chlorine compounds by combustion, the method comprising burning organic chlorine compounds in a gaseous atmosphere containing oxygen, the organic chlorine compounds being placed in contact with a catalyst of composite oxides selected from titanium-silicon composite oxides, titanium-zirconium composite oxides, and titanium-silicon-zirconium composite oxides, whereby the chlorine content is converted into hydrogen chloride (HCl).

2. A method of disposing of organic chlorine compounds by combustion, the method comprising burning organic chlorine compounds in a gaseous atmosphere containing oxygen, the organic chlorine compounds being placed in contact with a catalyst of composite oxides selected from titanium-zirconium composite oxides, titanium-silicon composite oxides and titanium-silicon-zirconium composite oxides, whereby the chlorine content is converted into hydrogen chloride (HCl), adsorbing the hydrogen chloride (HCl) by a basic absorbent, and then burning off the gaseous residue after the adsorption of hydrogen chloride.

3. A method defined in claim 1 or 2, wherein the organic chlorine compounds are placed in contact with the catalyst in the presence of a hydrogen source.

* * * * *